US012098909B2

(12) United States Patent
Chambers et al.

(10) Patent No.: US 12,098,909 B2
(45) Date of Patent: Sep. 24, 2024

(54) MAGAZINE POUCH

(71) Applicant: 5.11, Inc., Manteca, CA (US)

(72) Inventors: Justin Chambers, Costa Mesa, CA (US); Alan Anthony Vespe, Huntington Beach, CA (US); Sharon Jieun Park, Irvine, CA (US)

(73) Assignee: 5.11, Inc., Manteca, CA (US)

( * ) Notice: Subject to any disclaimer, the term of this patent is extended or adjusted under 35 U.S.C. 154(b) by 25 days.

(21) Appl. No.: 18/109,201

(22) Filed: Feb. 13, 2023

(65) Prior Publication Data

US 2023/0258440 A1 Aug. 17, 2023

Related U.S. Application Data

(60) Provisional application No. 63/310,277, filed on Feb. 15, 2022.

(51) Int. Cl.
*F42B 39/02* (2006.01)
*F42B 39/26* (2006.01)

(52) U.S. Cl.
CPC ..... *F42B 39/02* (2013.01); *F42B 39/26* (2013.01)

(58) Field of Classification Search
CPC ..... F42B 39/02; F42B 39/26; A45C 11/00; A45C 13/1046; A45C 13/002; A45C 13/30; A45C 3/001; A45C 7/0063; B65D 21/08; B65D 63/10; B65D 25/20
USPC .... 206/3; 224/931, 239, 237, 650, 652, 656, 224/674–675, 681, 914; 383/2, 4, 117
See application file for complete search history.

(56) References Cited

U.S. PATENT DOCUMENTS 900,094 A * 10/1908 Fisher ..... A45F 3/00 224/931
3,212,689 A * 10/1965 Woolfolk ..... F42B 39/02 206/254
5,152,442 A * 10/1992 Gallagher ..... F42B 39/02 224/931
5,351,868 A * 10/1994 Beletsky ..... A45F 5/02 224/667
6,202,908 B1 * 3/2001 Groover ..... F42B 39/02 224/931
7,918,371 B2 * 4/2011 Wilson ..... F41A 9/65 224/931
8,011,544 B1 * 9/2011 Howell ..... F42B 39/02 224/675
8,231,038 B2 * 7/2012 Felts ..... A45F 5/021 224/679
D697,711 S * 1/2014 Stevens, IV ..... D3/221
8,910,410 B2 * 12/2014 Peters ..... F41C 33/006 224/271

(Continued)

*Primary Examiner* — J. Gregory Pickett
*Assistant Examiner* — Brijesh V. Patel
(74) *Attorney, Agent, or Firm* — Knobbe, Martens, Olson & Bear, LLP

(57) ABSTRACT

A magazine pouch having a body that includes a front panel, a bottom panel, and a rear panel that cooperate to form a pocket configured to receive one or more magazines. The magazine pouch includes a first side panel that is separate from the body and a second side panel that is separate from the body and separate from the first side panel. At least one cord connects the first side panel and the second side panel to the body. A magazine retention member is configured to pass over the top of one or more magazines positioned within the pocket. The rear panel can be taller than the front panel.

20 Claims, 4 Drawing Sheets

(56) References Cited

U.S. PATENT DOCUMENTS

| | | | | |
|---|---|---|---|---|
| 8,991,672 | B2 * | 3/2015 | Hassler | B25H 3/00 224/663 |
| 9,194,679 | B2 * | 11/2015 | Orozco | F42B 39/02 |
| 9,394,080 | B2 | 7/2016 | Beck | |
| 9,759,536 | B2 | 9/2017 | Gadams et al. | |
| 9,795,210 | B2 * | 10/2017 | Evans | A45F 5/02 |
| 10,306,973 | B2 * | 6/2019 | Evans | F42B 39/02 |
| 10,352,652 | B2 * | 7/2019 | Higdon, Jr. | F41C 33/0236 |
| 10,571,220 | B2 * | 2/2020 | Toschi | F41C 33/04 |
| 10,612,888 | B2 * | 4/2020 | Toschi | F41C 33/04 |
| 10,888,150 | B2 * | 1/2021 | Cole | F42B 39/02 |
| 10,928,172 | B1 * | 2/2021 | Mironski | F42B 39/02 |
| 10,962,318 | B2 * | 3/2021 | LeMarbe | A45F 5/022 |
| 11,033,095 | B1 * | 6/2021 | VanHeusen | A45F 5/00 |
| 2006/0208025 | A1 * | 9/2006 | Grundy | F41C 33/041 224/660 |
| 2007/0017947 | A1 * | 1/2007 | Fenton | A45C 7/0063 224/652 |
| 2008/0061099 | A1 * | 3/2008 | Tilby | A45C 11/00 224/675 |
| 2015/0208796 | A1 * | 7/2015 | Seuk | A45F 5/021 224/660 |
| 2016/0066680 | A1 * | 3/2016 | Hazeltine | A45F 5/021 224/676 |
| 2016/0327382 | A1 | 11/2016 | Beck | |
| 2020/0261286 | A1 * | 8/2020 | Evans | A45F 3/14 |

* cited by examiner

MAGAZINE POUCH

CROSS-REFERENCE TO RELATED APPLICATIONS

This application claims priority under 35 U.S.C. § 119(e) to U.S. Provisional Patent Application No. 63/310,277, entitled "MAGAZINE POUCH" and filed on Feb. 15, 2022, the entire disclosure of which is hereby incorporated by reference herein.

BACKGROUND

Field

The present disclosure generally relates to ammunition storage. In particular, the present disclosure relates to an ammunition magazine pouch.

Description of Related Art

Existing ammunition magazine pouches are capable of holding an ammunition magazine. In some cases, the magazine pouches are capable of holding multiple ammunition magazines. However, a need exists for improved magazine pouches, which address one or more shortcomings of the prior art and/or provide the public with a useful choice.

SUMMARY

The systems, methods and devices described herein have innovative aspects, no single one of which is indispensable or solely responsible for their desirable attributes. Without limiting the scope of the claims, some of the advantageous features will now be summarized.

An aspect of the present disclosure involves a magazine pouch having a body that includes a front panel, a bottom panel, and a rear panel that cooperate to form a pocket configured to receive one or more magazines. The magazine pouch includes a first side panel that is separate from the body and a second side panel that is separate from the body and separate from the first side panel. At least one cord connects the first side panel and the second side panel to the body.

In some configurations, the at least one cord further connects the front panel to the rear panel. In some configurations, the front panel further comprises a plurality of front loops and the rear panel further comprises a plurality of rear loops, and the at least one cord connects the front panel to the rear panel via the front loops and the rear loops.

In some configurations, the rear panel is taller than the front panel.

In some configurations, the at least one cord comprises a first cord and a second cord. In some configurations, the first cord is configured to adjust a first side of the magazine pouch and the second cord is configured to adjust a second side of the magazine pouch.

In some configurations, the at least one cord is elastic.

In some configurations, the first side panel further comprises at least one first side loop and the second side panel further comprise at least one second side loop.

In some configurations, the at least one cord connects the first side panel to the body via the at least one first side loop and wherein the at least one cord connects the second side panel to the body via the at least one second side loop.

In some configurations, the magazine pouch further includes a pouch connector. In some configurations, the pouch connector connects the magazine pouch to another object. In some configurations, the pouch connector is configured to connect the magazine pouch to a webbing mount.

In some configurations, the first side panel and the second side panel are removable.

In some configurations, the magazine retention member includes a magazine retention cord and a magazine retention tab. The magazine retention tab further includes at least one loop, wherein the magazine retention cord passes through at least one loop.

In some configurations, the pocket is configured to receive multiple magazines.

In some configurations, magazine retention member is configured to pass over the top of one or more magazines positioned within the pocket. The magazine retention member is connected to the front panel and the rear panel.

An aspect of the present disclosure involves a magazine pouch including a body having a front panel, a bottom panel, and a rear panel that cooperate to form a pocket configured to receive one or more magazines. The rear panel is taller than the front panel. The magazine pouch further includes first side panel, a second side panel, and at least one cord connecting the first side panel and the second side panel to the body.

In some configurations, the at least one cord further connects the front panel to the rear panel. In some configurations, the front panel further comprises a plurality of front loops and the rear panel further comprises a plurality of rear loops, and the at least one cord connects the front panel to the rear panel via the front loops and the rear loops.

In some configurations, the at least one cord comprises a first cord and a second cord. In some configurations, the first cord is configured to adjust a first side of the magazine pouch and the second cord is configured to adjust a second side of the magazine pouch.

In some configurations, the at least one cord is elastic.

In some configurations, the first side panel further comprises at least one first side loop and the second side panel further comprise at least one second side loop. In some configurations, the at least one cord connects the first side panel to the body via the at least one first side loop and wherein the at least one cord connects the second side panel to the body via the at least one second side loop.

In some configurations, further comprising a pouch connector. In some configurations, the pouch connector connects the magazine pouch to another object. In some configurations, the pouch connector is configured to connect the magazine pouch to a webbing mount.

In some configurations, the first side panel and the second side panel are removable.

In some configurations, the magazine retention member comprises a magazine retention cord and a magazine retention tab, the magazine retention tab further comprising at least one loop, the magazine retention cord passing through at least one loop.

In some configurations, wherein the pocket is configured to receive multiple magazines.

In some configurations, a magazine retention member is configured to pass over the top of one or more magazines positioned within the pocket. The magazine retention member is connected to the front panel and the rear panel.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are not to be considered limiting of its scope, the disclosure will be described with additional specificity and detail through the use of the accompanying drawings.

DETAILED DESCRIPTION

Figure 1:
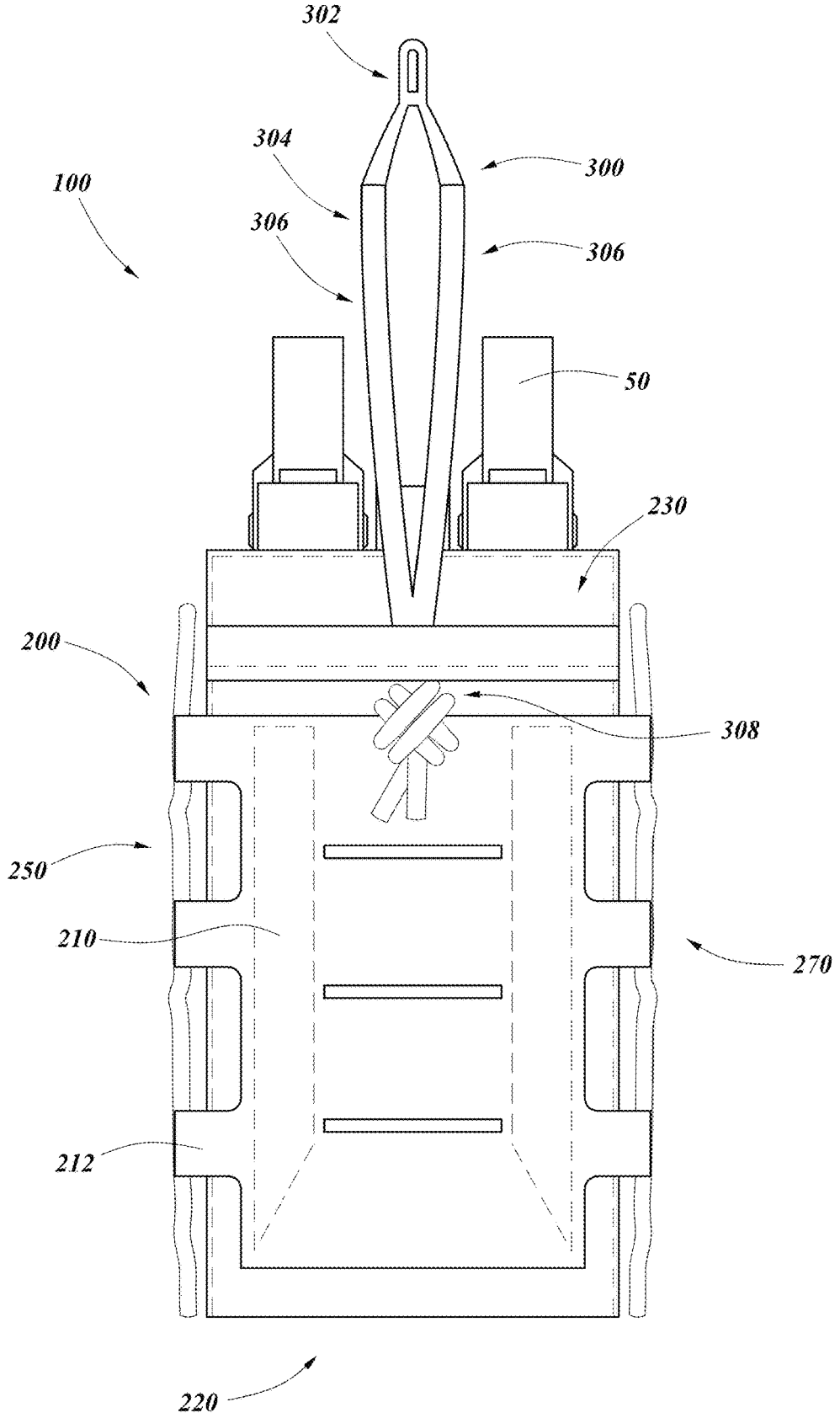
FIG. 1 is a front view of an embodiment of the magazine pouch.

Embodiments of the magazine pouch will now be described with reference to the accompanying Figures, wherein like numerals refer to like or similar elements throughout. Although several embodiments, examples and illustrations are disclosed below, it will be understood by those of ordinary skill in the art that the inventions described herein extends beyond the specifically disclosed embodiments, examples and illustrations, and can include other uses of the inventions and obvious modifications and equivalents thereof. The terminology used in the description presented herein is not intended to be interpreted in any limited or restrictive manner simply because it is being used in conjunction with a detailed description of certain specific embodiments of the inventions. In addition, embodiments of the inventions can comprise several novel features and no single feature is solely responsible for its desirable attributes or is essential to practicing the inventions herein described.

Certain terminology may be used in the following description for the purpose of reference only, and thus are not intended to be limiting. For example, terms such as "above" and "below" refer to directions in the drawings to which reference is made. Terms such as "front," "back," "left," "right," "rear," and "side" describe the orientation and/or location of portions of the components or elements within a consistent but arbitrary frame of reference which is made clear by reference to the text and the associated drawings describing the components or elements under discussion. Moreover, terms such as "first," "second," "third," and so on may be used to describe separate components. Such terminology may include the words specifically mentioned above, derivatives thereof, and words of similar import.

FIGS. 1-5 illustrate an embodiment of a magazine pouch 100, which can be configured to hold one or more magazines. The illustrated magazine pouch 100 is configured to hold multiple magazines. Thus, the magazine pouch 100 can be referred to as a multi magazine pouch herein. The magazine pouch 100 includes a body 200. The illustrated body 200 includes a front panel 210, a bottom panel 220, a rear panel 230, that cooperate to form a pocket configured to receive one or more magazines 400.

The magazine pouch 100 may further include a first side panel 250 and a second side panel 270. At least one cord 260 connects the first side panel 250 and the second side panel 270 to the body 200. As mentioned above, the at least one cord 260 connects the first side panel 250 and the second side panel 270 to the body. The first side panel 250 and second side panel 270 preferably are separate from each other and are separate from the body 200.

A magazine retention member 300 is configured to retain the magazine(s) within the pocket of the magazine pouch 100. In the illustrated arrangement, the magazine retention member 300 is connected to the front panel 210 and the rear panel 230 and is configured to pass over the top of one or more magazines 400 positioned within the pocket. However, in alternative arrangements, the retention member 300 could be connected to the side panels 250, 270 or a combination of the front panel 210, rear panel 230 and side panels 250, 270. Furthermore, it is possible to omit the magazine retention member 300 by providing an alternative arrangement for magazine retention, such as utilizing internal compression from the cord(s) 260 or another suitable mechanism for creating internal compression.

As discussed above, the body 200 includes the front panel 210, the bottom panel 220, and the rear panel 230. The body 200 may be made from mesh, cloth, leather, canvas, rubber, or any suitable material. Any of these portions may be made from the same material or from different materials. In some embodiments, the front panel 210, the bottom panel 220, and the rear panel 230, or any combination thereof, may be formed as a single piece, as shown for example in FIG. 5. The single piece can be an integrated assembly of several parts or can be formed as a unitary structure from a single piece of material.

In other embodiments, the front panel 210, the bottom panel 220, and the rear panel 230 may each be a distinct piece. If the front panel 210, the bottom panel 220, and the rear panel 230 are different components they may be connected with hook and loop, clips, hooks, buckles, thread, bungees, or any other connection type. The body 200 may form, substantially form, or partially form, a pocket 201 in which the magazine(s) may be stored. The pocket 201 may be any shape or form that at least partially contains the magazines 400. In some configurations, the pocket may correspond in shape to an ammunition magazine 400. The pouch 100 may also be used to, or may be modified to be used to, store other items of a similar shape to magazines.

The front panel 210 and the rear panel 230 may be substantially the same size or they may differ in size. In the illustrated embodiment, the rear panel 230 is taller than the front panel 210. The rear panel 230 may be taller in that it has a greater height from a bottom edge to a top edge relative to the front panel 210. Alternatively, the rear panel 230 may be taller in the final assembled state of the pouch 100. That is, the top edge of the rear panel 230 can be at a higher location than the top edge of the front panel 210 when the pouch 100 is in an upright orientation. The front panel 210 and rear panel 230 may vary from one another in height, width, thickness, or shape.

In the illustrated arrangement, the front panel 210 further includes one or more front loops 212. The front loops 212 may be made of the same material as the rest of the front panel 210 such as cloth or fabric. The front loops 212 may be made of a different material than the front panel 210, such as a plastic, metal, cable, or another suitable material. In some embodiments, six (6) front loops 212 are provided, with three (3) front loops 212 on each side of the front panel 210 as illustrated in FIG. 1. However, there may be less than six (6) front loops 212, or there may be more than six (6) front loops 212. The number of front loops 212 on each side of the front panel 210 need not be the same and the location of the front loops 212 on each side of the front panel 210 need not be symmetrical. Further, the front loops 212 need not be loops but may be any type of connection such as buckles, clips, hooks, rings, eyelets, or another suitable connection type. In the illustrated arrangement, the front loops 212 are made of the same material as the front panel 210, are symmetrically located, and are flexible, allowing them to conform to the shape of and securely hold the magazine(s) 400.

Figure 2:
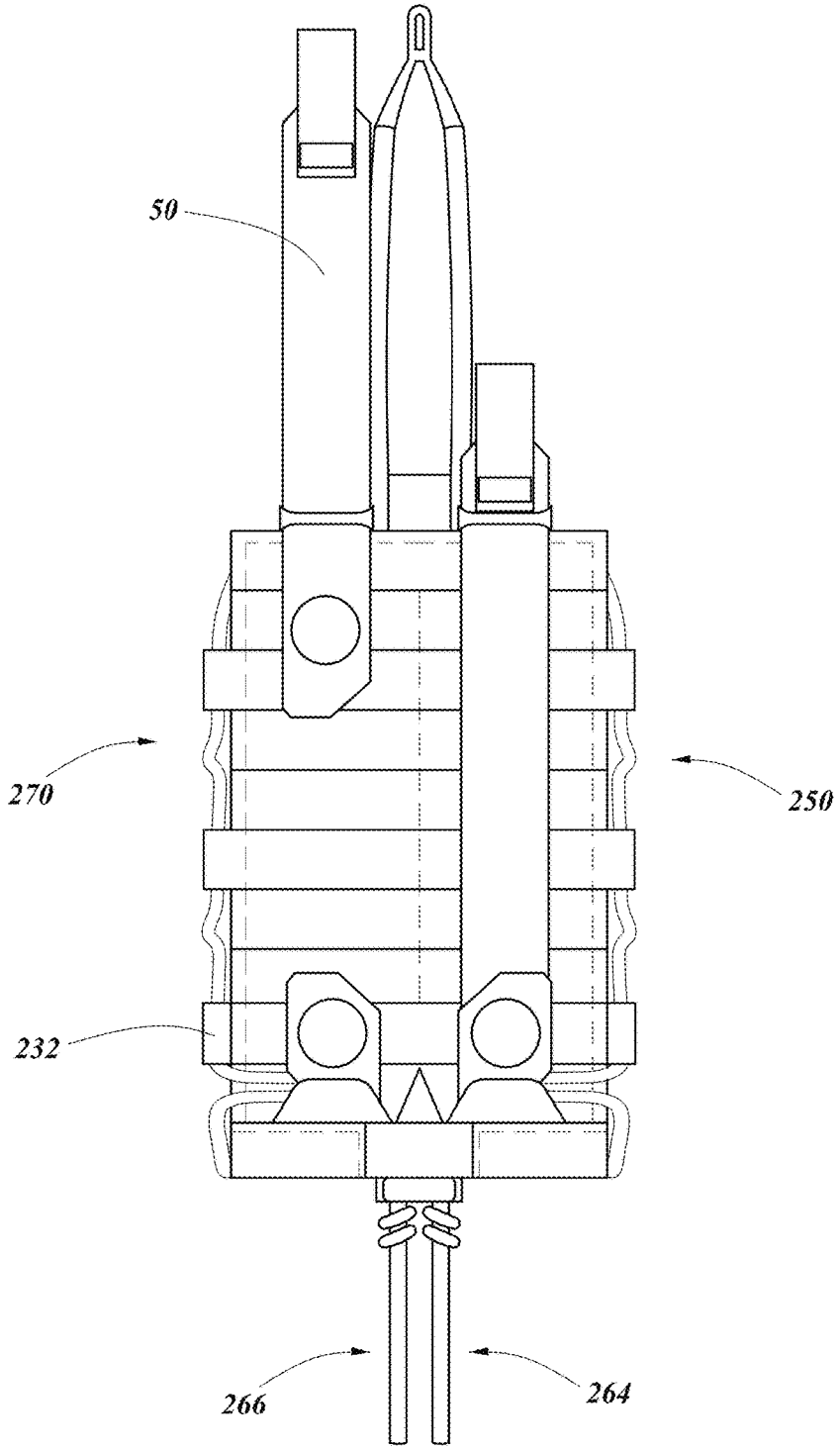
FIG. 2 is a rear view of the magazine pouch.

As shown in FIG. 2, the illustrated rear panel 230 includes one or more rear loops 232. The rear loops 232 may be made of the same material as the rear panel 230 such as cloth or fabric. The rear loops 232 may be made of a different material than the rear panel 230, such as a plastic, metal, cable, or other suitable material. In some embodiments, six (6) rear loops 232 are provided, with three (3) rear loops 232 on the left side and three (3) rear loops 232 on the right side of the rear panel 230. However, in some embodiments there may only be one rear loop 232 on each side, there may be less than six (6) rear loops 232, or there may be more than six (6) rear loops 232. The number of loops 232 on each side need not be the same and they need not be symmetrical. Further, the rear loops 232 need not be loops but may be any type of connection such as buckles, clips, hooks, rings, eyelets, or other suitable connection type.

Figure 3:
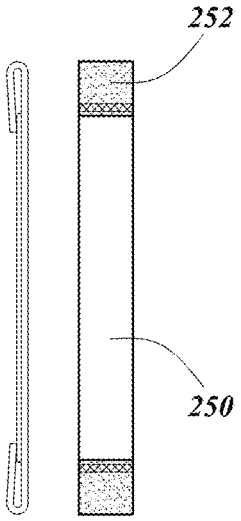
FIG. 3 shows a front and side view of the first side panel of the magazine pouch.

The first side panel 250 may include at least one first side connection 252 and the second side panel 270 may include at least one second side connection 272. The first side connection 252 and the second side connection 272 may be loops, eyelets, hooks, or any suitable connection type. The side connections 252 and 272 may be made of the same material as the rest of the first side panel 250 and the second side panel 270, or they may be made of a different material. There may be a number of connections as shown, there may only be one, or there may be more loops. In the illustrated arrangement, as shown in FIG. 3, the first side panel 250 has two loop type connections constituting a first side connection 252. The connections are located on opposing ends of the side panel and are formed by folding over an end portion of the same piece of material that defines the first side panel 250 and connecting the end portion to the side panel 250. This is but one embodiment of the first side panel 250 and first side connection 252. In the present arrangement, the second side panel 270 and the second side connection 272 are the same as or similar to the first side panel 250 and the first side connection 252. However, these components need not be the same, the panel or sides may differ in form, construction, material, shape, or any other foreseeable property. For example, the first side connection 252 and the second side connection 272 may increase in connections or decrease in connections dependent on the number of front loops 212 and rear loops 232.

In the illustrated arrangement, at least one cord 260 passes through the front loops 212, the rear loops 232, the first side connection 252, and the second side connection 272. The cord 260 secures the first side panel 250 and the second side panel 270 to the magazine pouch 100 via the first side connection 252 and the second side connection 272. The cord 260 also secures the front panel 210 to the rear panel 230. The cord may connect all of the front panel 210, the rear panel 230, the first side panel 250, and the second side panel 270, or it may connect only some of these components. In some embodiments, the cord 260 may further connect the bottom panel 220 to any or all of the previously mentioned components. The cord 260 in the illustrated arrangement is made of an elastic material but may be made of other suitable materials, such as rope, cable, wire, or any like material.

The cord 260 is configured to adjust a size of the pocket 201. In some configurations the cord 260 is configured to adjust the front panel 210 and the rear panel 230 in a direction towards and away from one another. To reduce a size of the pocket 201, the cord 260 may be tightened to pull the front panel towards the rear panel, substantially securing the magazines in the magazine pouch 100. To increase a size of the pocket 201, the cord 260 may be loosened to allow the front panel and the rear panel to move further away from one another. The adjustment can allow the magazine pouch 100 to accommodate a desired number of magazines within a range for which the pouch 100 is designed.

In some configurations, the cord 260 may also pull different parts of the front panel 210 and the rear panel 230 in different amounts. For example, the cord 260 may be tightened such that there is a greater bias force at the top of the front panel 210 and the top of the rear panel 230 towards each other. In another example, the cord 260 may be tightened such that there is a greater bias force on a first side of the front panel 210 and the first side of the rear panel 230 towards each other. Further the cord 260 may connect the components mentioned, the front panel 210, the bottom panel 220, the rear panel 230, the first side panel 250, and the second side panel 270, or any combination thereof, in any pattern, manner, direction, or order. The present embodiment displays a crossing cord connection. The cord 260 passes through the front panel 210, through the first side panel 250, through the rear panel 230, through the front panel 210, through the rear panel 230, through the first side panel 250, through the front panel 210, and so on.

In some configurations, the cord 260 may comprise a first cord 264 and a second cord 266. The first cord 264 and the second cord 266 may operate together or they may operate independently. In the arrangement shown in FIG. 2, the cords 264, 266 may operate substantially independently, allowing for different tensions in the cords 264, 266, and thus different compressions on the magazine(s). In the embodiment shown, both the first cord 264 and the second cord 266 are located such that they may be gripped at the same time and thus may be tightened to substantially the same degree with a single motion. The first cord 264 and second cord 266 may control the tension in a first side and a second side as shown in the illustrated arrangement. In addition or in the alternative, the first cord 264 and the second cord 266 may control tension in an upper portion and a lower portion, in the same portion, in partially the same portion, in different magazine pouch components, or in any other foreseeable overlapping or non-overlapping portions. The first cord 264 and second cord 266 may be made of the same material, or they may be made of different materials. The first cord 264 and the second cord 266 may be made of any of the materials previously listed as possible for the cord 260 or any other suitable material for the application.

Figure 4:
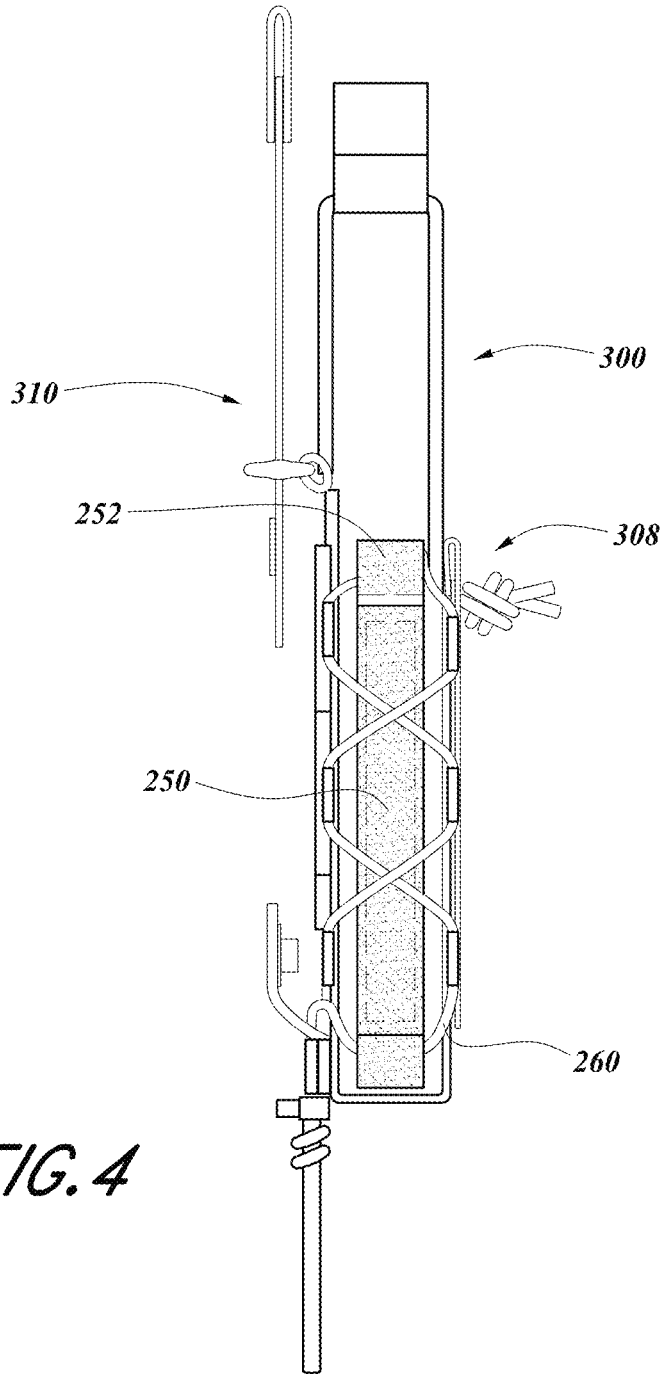
FIG. 4 is a side view of the magazine pouch.
Figure 5:
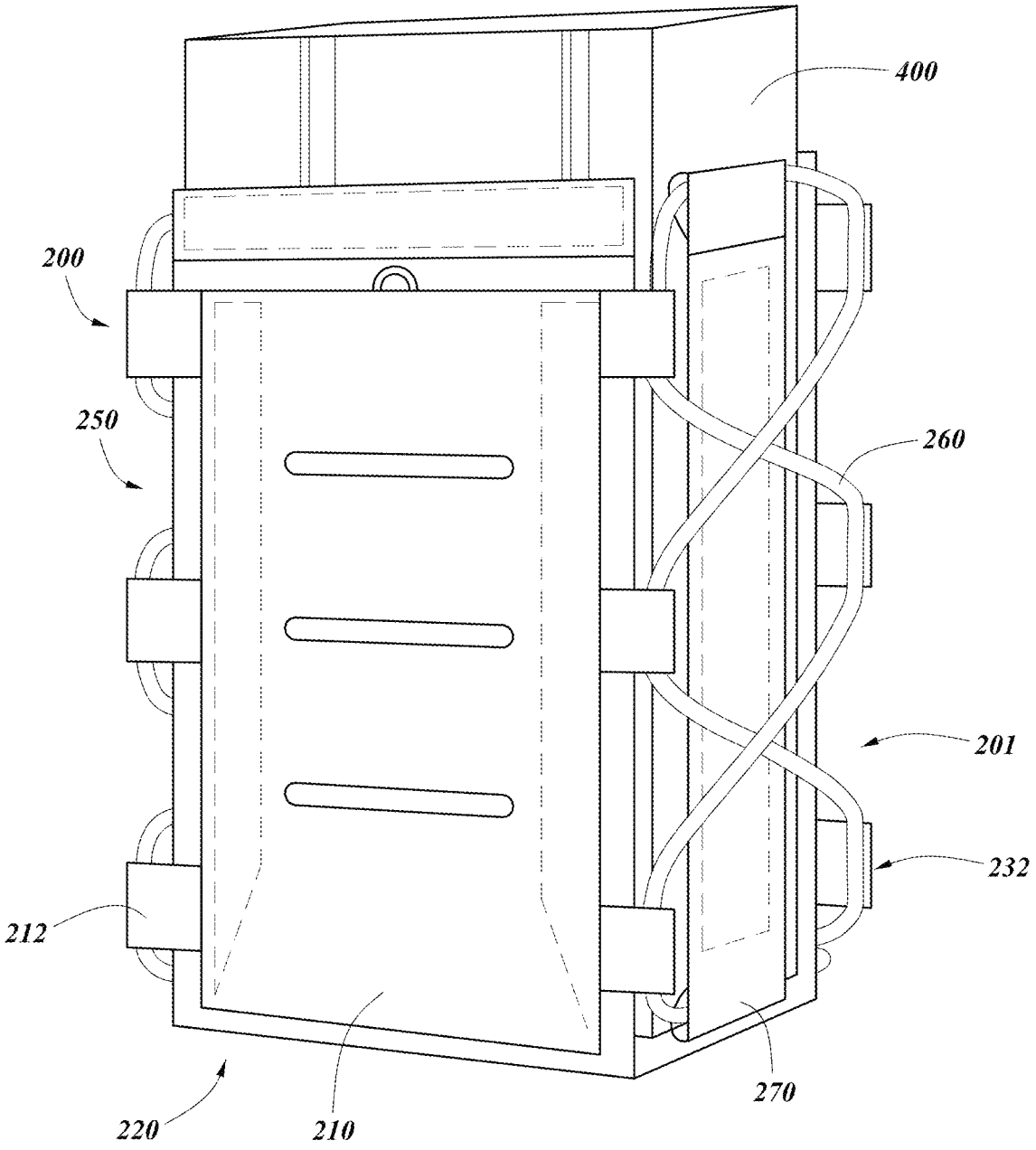
FIG. 5 is a perspective view of the magazine pouch.

In the arrangement shown in FIG. 4, the magazine retention member 300 may pass over the top of the magazine(s) 400, securing the magazine(s) 400 in the magazine pouch 100. The magazine retention member may primarily connect to the front panel 210 or the rear panel 230 of the magazine pouch 100 via the first connection 308 (FIG. 1). The magazine retention member 300 may then pass over the top of the magazines and secondarily connect to the body 200 via the second connection 310. The second connection 310 may connect to the front panel 210 or the rear panel 230, whichever was not connected to in the first connection 308. The magazine retention member 300 may be connected via the first connection 308 and the second connection 310 anywhere on the front panel 210 or the rear panel 230, which includes the inside of the front panel 210 panel or the rear panel 230, the outside of the front panel 210 or the rear panel 230, anywhere on the front panel 210 or the rear panel 230, or anywhere tangentially connected to the front panel 210 or the rear panel 230. The magazine retention member 300 may pass directly over the top of the magazine(s) 400 as shown in the illustrated arrangement or may pass over the top of the magazine(s) 400 at an angle. The first connection 308 and second connection 310 may be clips, loops, knots, hook and loop, eyelets, stitching, or any other suitable connection type. The magazine retention member 300 may be a cord type as presently shown or it may be a strap, a cable, a flap, a rope, twine, or any other suitable type. The magazine retention member 300 may be removable or interchangeable. There may be multiple magazine retention member 300 options, each one offering different benefits and designed for different types of magazine or other items held by magazine pouch 100.

The magazine retention member 300 may comprise multiple elements that extend over the top of the magazine(s). In the illustrated arrangement, the magazine retention member 300 comprises a magazine retention cord 304 comprising two retention cord elements 306. In the illustrated arrangement, both retention cord elements 306 are affixed to the same point; however, they may be affixed to different points in alternative arrangements. The magazine retention member 300 may further include a magazine retention tab 302 or multiple tabs. The magazine retention tab 302 may be made of plastic, leather, cloth, metal, or any other suitable material. The magazine retention tab 302 may provide for additional grip when securing the magazine retention member 300 and may reduce the impact on the top of the magazine(s), where they may be more fragile.

The illustrated magazine pouch 100 may further comprise a magazine connector 50. The magazine connector 50 may allow the magazine pouch 100 to operate independently or to be connected to any number of other items. The magazine connector 50 may be a webbing mount, such as MOLLE webbing, a belt, other types of straps, or any other suitable connection type allowing a user to carry the magazine pouch 100 independently or connecting the magazine pouch 100 to the user. The magazine connector 50 may also be any suitable connection type to connect the magazine pouch 100 to a backpack, another type of bag, or any other foreseeable object. The magazine connector 50 may be of a strap type, a hook and loop type, a clip type, a buckle type, or any other known connection type or combination thereof. In the illustrated arrangement, the magazine connector 50 connects the rear panel 230 to an object. The magazine connector 50 need not connect the rear panel 230 to an object, the magazine connector 50 may be a connection to any panel or element of the magazine pouch 100. The magazine connector 50 may be connected to the front panel 210, the bottom panel 220, the first side panel 250, the cord 260, the second side panel 270, or any other element of the magazine pouch 100.

CONCLUSION

It should be emphasized that many variations and modifications may be made to the herein-described embodiments, the elements of which are to be understood as being among other acceptable examples. All such modifications and variations are intended to be included herein within the scope of this disclosure and protected by the following claims. Moreover, any of the steps described herein can be performed simultaneously or in an order different from the steps as ordered herein. Moreover, as should be apparent, the features and attributes of the specific embodiments disclosed herein may be combined in different ways to form additional embodiments, all of which fall within the scope of the present disclosure.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

Moreover, the following terminology may have been used herein. The singular forms "a," "an," and "the" include plural referents unless the context clearly dictates otherwise. Thus, for example, reference to an item includes reference to one or more items. The term "ones" refers to one, two, or more, and generally applies to the selection of some or all of a quantity. The term "plurality" refers to two or more of an item. The term "about" or "approximately" means that quantities, dimensions, sizes, formulations, parameters, shapes and other characteristics need not be exact, but may be approximated and/or larger or smaller, as desired, reflecting acceptable tolerances, conversion factors, rounding off, measurement error and the like and other factors known to those of skill in the art. The term "substantially" means that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

Numerical data may be expressed or presented herein in a range format. It is to be understood that such a range format is used merely for convenience and brevity and thus should be interpreted flexibly to include not only the numerical values explicitly recited as the limits of the range, but also interpreted to include all of the individual numerical values or sub-ranges encompassed within that range as if each numerical value and sub-range is explicitly recited. As an illustration, a numerical range of "about 1 to 5" should be interpreted to include not only the explicitly recited values of about 1 to about 5, but should also be interpreted to also include individual values and sub-ranges within the indicated range. Thus, included in this numerical range are individual values such as 2, 3 and 4 and sub-ranges such as "about 1 to about 3," "about 2 to about 4" and "about 3 to about 5," "1 to 3," "2 to 4," "3 to 5," etc. This same principle applies to ranges reciting only one numerical value (e.g., "greater than about 1") and should apply regardless of the breadth of the range or the characteristics being described. A plurality of items may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. Furthermore, where the terms "and" and "or" are used in conjunction with a list of items, they are to be interpreted broadly, in that any one or more of the listed items may be used alone or in combination with other listed items. The term "alternatively" refers to selection of one of two or more alternatives, and is not intended to limit the selection to only those listed alternatives or to only one of the listed alternatives at a time, unless the context clearly indicates otherwise.

What is claimed is:

1. A magazine pouch, comprising:

a body comprising a front panel, a bottom panel, and a rear panel that cooperate to form a pocket configured to receive one or more magazines;

a first side panel that is separate from the body;

a second side panel that is separate from the body and separate from the first side panel; and at least one cord connecting the first side panel and the second side panel to the body;

wherein the front panel further comprises a plurality of front loops extending outward from a corresponding one of each side edge of the front panel and the rear panel further comprises a plurality of rear loops extending outward from a corresponding one of each side edge of the rear panel, and the at least one cord connects the front panel to the rear panel by passing through the plurality of front loops and the plurality of rear loops.

2. The magazine pouch of claim 1, wherein the rear panel is taller than the front panel.

3. The magazine pouch of claim 1, where the at least one cord comprises a first cord and a second cord.

4. The magazine pouch of claim 3, wherein the first cord is configured to adjust a first side of the magazine pouch and the second cord is configured to adjust a second side of the magazine pouch.

5. The magazine pouch of claim 1, wherein the at least one cord is elastic.

6. The magazine pouch of claim 1, wherein the first side panel further comprises at least one first side loop and the second side panel further comprise at least one second side loop.

7. The magazine pouch of claim 6, wherein the at least one cord connects the first side panel to the body via the at least one first side loop and wherein the at least one cord connects the second side panel to the body via the at least one second side loop.

8. The magazine pouch of claim 1, further comprising a pouch connector.

9. The magazine pouch of claim 8, wherein the pouch connector connects the magazine pouch to another object.

10. The magazine pouch of claim 8, wherein the pouch connector is configured to connect the magazine pouch to a webbing mount.

11. The magazine pouch of claim 1, wherein the first side panel and the second side panel are removable.

12. The magazine pouch of claim 1, further comprising a magazine retention member configured to pass over a top of one or more magazines positioned within the pocket, the magazine retention member being connected to the front panel and the rear panel.

13. The magazine pouch of claim 12, wherein the magazine retention member comprises a magazine retention cord and a magazine retention tab, the magazine retention tab further comprising at least one loop, the magazine retention cord passing through the at least one loop.

14. The magazine pouch of claim 1, wherein the pocket is configured to receive multiple magazines.

15. A magazine pouch, comprising:

a body comprising a front panel, a bottom panel, and a rear panel that cooperate to form a pocket configured to receive one or more magazines, further comprising an opening to the pocket located opposite the bottom panel, the body defining a length direction extending between the opening and the bottom panel;

a first side panel;

a second side panel; and at least one cord connecting the first side panel and the second side panel to the body;

wherein the front panel further comprises a plurality of front loops and the rear panel further comprises a plurality of rear loops, and the at least one cord passes in the length direction through each of the plurality of front loops and each of the plurality of rear loops.

16. The magazine pouch of claim 15, wherein the at least one cord further connects the front panel to the rear panel via the plurality of front loops and the plurality of rear loops.

17. The magazine pouch of claim 15, where the at least one cord comprises a first cord and a second cord.

18. The magazine pouch of claim 17, wherein the first cord connects the front panel to the first side panel to the rear panel.

19. The magazine pouch of claim 15, wherein the at least one cord engages with the first side panel and the second side panel above an uppermost loop of the plurality of front loops.

20. The magazine pouch of claim 15, wherein the at least one cord engages with the first side panel and the second side panel below a lowermost loop of the plurality of rear loops.

* * * * *